US005873432A

United States Patent [19]

Cho

[11] Patent Number: 5,873,432

[45] Date of Patent: Feb. 23, 1999

[54] ABSEIL RESCUE SYSTEM WITH VELOCITY CONTROL SYSTEM

[76] Inventor: Kunlin Cho, 17 Alley 1, Lane 43, Tapeng Road, Taichung, Taiwan

[21] Appl. No.: 112,534

[22] Filed: Jul. 9, 1998

[51] Int. Cl.[6] ..... A62B 1/14

[52] U.S. Cl. ..... 182/72; 182/71; 182/193; 182/192; 182/5; 188/65.3

[58] Field of Search ..... 182/191, 192, 182/193, 5, 71, 72, 240; 188/65.3

[56] References Cited

U.S. PATENT DOCUMENTS 457,285 8/1891 Makely .
588,889 8/1897 Wabnitz .
765,726 7/1904 Crowe .
4,883,146 11/1989 Jarner ..... 182/5

*Primary Examiner*—Alvin Chin-Shue
*Attorney, Agent, or Firm*—Connolly & Hutz

[57] ABSTRACT

An abseil rescue system with a velocity control system, allowing a user to descend on a rope, comprising two holders, two brakes, two retarders, and a frame. The retarder and the brake grip the rope of the abseil rescue system simultaneously, allowing to control the velocity of descent accurately. The weight of the user helps to grip the rope, such that for a tight grip the user is not required to apply much force.

7 Claims, 9 Drawing Sheets

ABSEIL RESCUE SYSTEM WITH VELOCITY CONTROL SYSTEM

BACKGROUND OF THE INVENTION

1. Field of the Invention

The present invention relates to an abseil rescue system with a velocity control system, particularly to an abseil rescue system with a velocity control system having a brake with an enlarged area, allowing single-hand control of the velocity of descent with increased sensitivity and stability.

2. Description of Related Art

In U.S. Patent Application Ser. No. 08/987,002 an abseil rescue system with a velocity control system was disclosed, which allows descent from a high building along a rope. Descent is controlled by friction of the retarder on the rope, which in turn depends on the grip of the user and is hard to control.

SUMMARY OF THE INVENTION

The present invention has a retarder and a brake, which make the rope be shaped like the letter S and are arranged inside each other. The retarder and the brake grip the rope of the abseil rescue system simultaneously, allowing to control the velocity of descent with increased stability. The weight of the user helps to grip the rope, such that for a tight grip the user is not required to apply much force. This benefits users with little physical force, like women and children, to control the velocity of descent flexibly and stably.

The object of the present invention is to provide a velocity control system for an abseil rescue system, which allows flexible control of descent from high rise buildings.

The present invention can be more fully understood by reference to the following description and accompanying drawings.

DETAILED DESCRIPTION OF THE PREFERRED EMBODIMENTS

Figure 1:
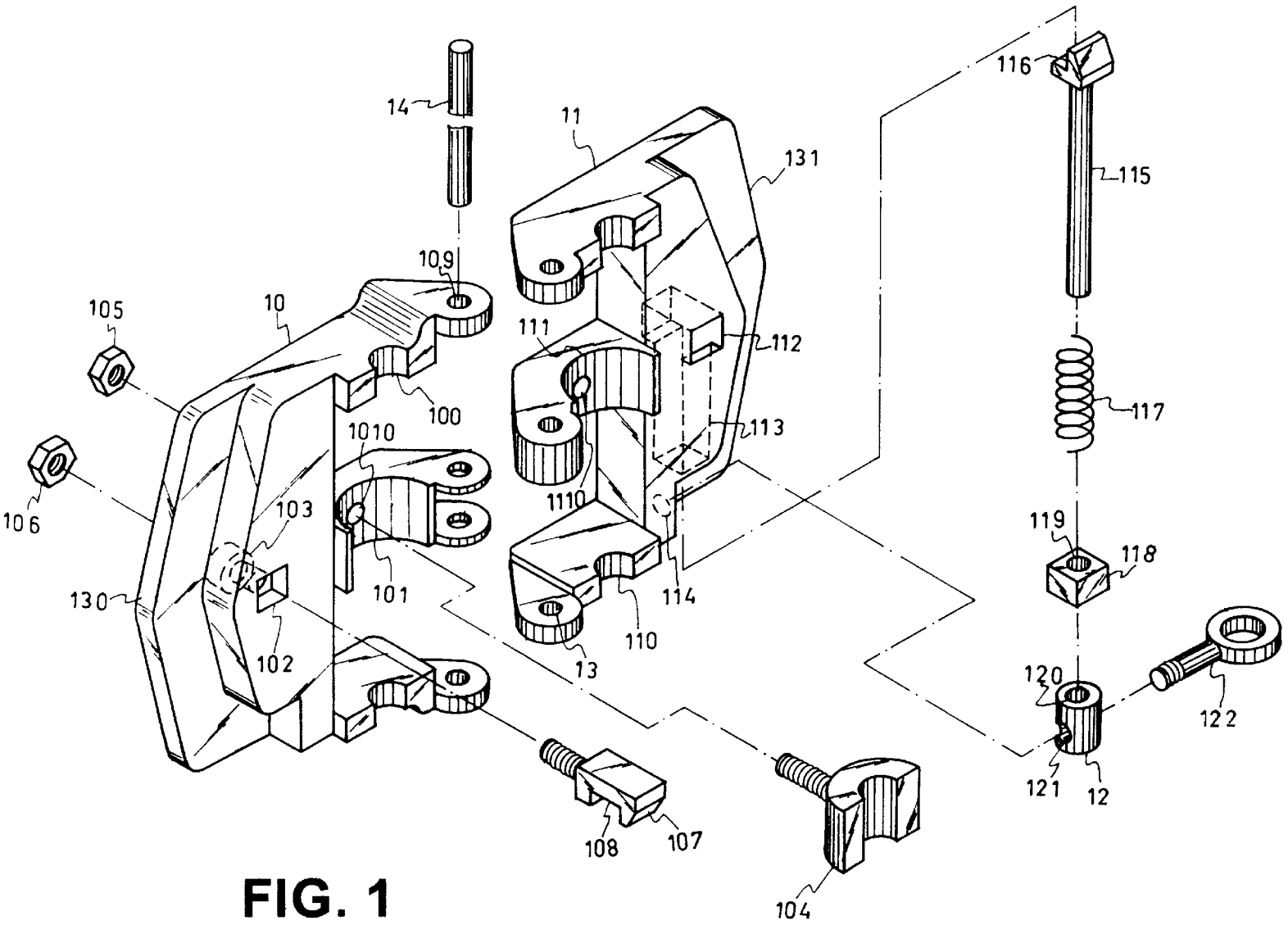
FIG. 1 is an exploded perspective view of the holder of the present invention.
Figure 2:
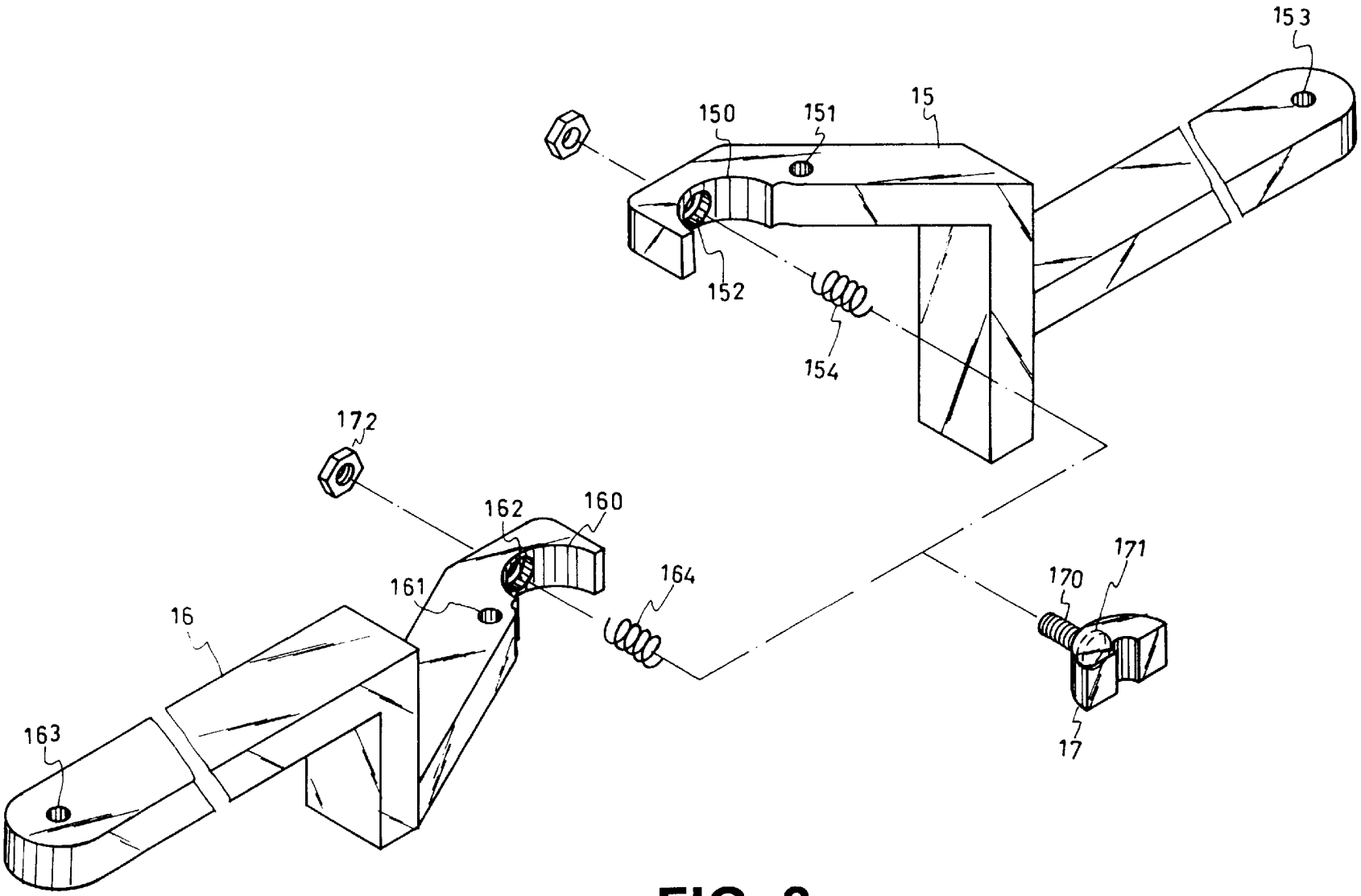
FIG. 2 is an exploded perspective view of the brake of the present invention.
Figure 3:
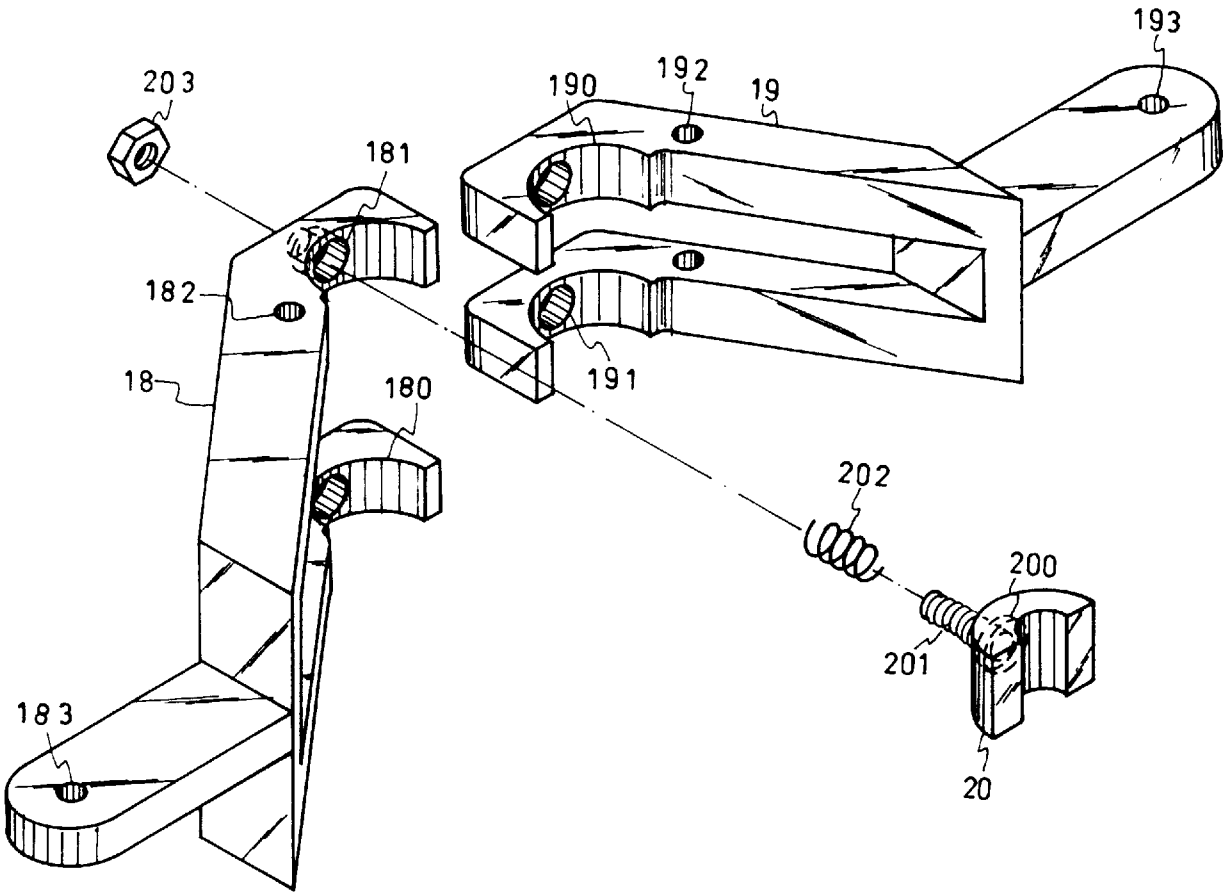
FIG. 3 is an exploded perspective view of the retarder of the present invention.

As shown in FIG. 1, FIG. 2 and Fig. 3, the velocity control system of the present invention mainly comprises: two holders 10, 11; two brakes 15, 16; and two retarders 18, 19.

The holders 10, 11 have front ends, which are hingedly connected, and rear ends 130, 131. A rope 23 is gripped by the holders 10, 11 at the front ends thereof. The holder 10 has a front part with two guiding openings 100 aligned in a vertical direction and a gripper 101 between the guiding openings 100. In the same way, the holder 11 has a front part with two guiding openings 110 aligned in the vertical direction and a gripper 111 between the guiding openings 110. The front ends of the holders 10, 11 are connected by a vertical shaft 14, passing through a plurality of aligned holes 109, 13. Transverse holes 1010, 1110 are bored into the grippers 101, 111, respectively, for mounting brakes 104 with nuts 105. The holder 10 further has a transverse opening 102, aligned with a fisheye hole 103, for accommodating and fastening a blocking part 107 with a nut 106. The blocking part 107 has a downward opened, wide groove 108. Another transverse opening 112 passes through the holder 11. From the transverse opening 112 a vertical opening 113 extends downwards within the holder 11. A blocking rod 115 with an upper end and a lower end, a spring 117 and a fastening element 118 are inserted in the vertical opening 113. The blocking rod 115 passes through a hole 119 in the fastening element 118 and has a blocking head 116 on the upper end, which extends into the transverse opening 112. When the holders 10, 11 are brought together, the blocking head 116 on the holder 11 engages with the groove 108 on the holder 10, preventing the holders 10, 11 from separating again. A tubelet 12 next to the lower end of the blocking rod 115 blocks the blocking rod 115 from moving downwards, keeping the blocking head 116 engaged with the groove 108 of the blocking part 107. The tubelet 12 in turn is blocked from moving downwards by a transverse pin 122, passing through a transverse hole 121 in the tubelet 12. The transverse pin 122 has a thread which engages with a threaded hole 114 in the holder 11. For separating the holders 10, 11, the transverse pin 122 is screwed out of the threaded hole 114. Then the rear ends 130, 131 of the holders 10, 11 part, allowing to insert or remove the rope 23.

Referring to FIG. 2, the brakes 15, 16 are hingedly connected by the vertical shaft 14 (shown in FIG. 1), passing through holes 151, 161, such that the brakes 15, 16 are vertically located between the guiding openings 100, 101. The brakes 15, 16 have front ends with grippers 150, 160, which are in the same way located between the guiding openings 100, 101. Each of the grippers 150, 160 has a transverse fisheye hole 152, 162, respectively. Each of the fisheye holes 152, 162 carries a brake pad 17, having a friction pad 171 and threaded bolt 170, passing through the fisheye hole 152, 162 and fastened with a nut 172. A spring 154, 164 on the bolt 170 presses the brake pad 17 inwards. The brakes 15, 16 further have rear ends with vertical holes 153, 163 for passing through a pulling cord 30, as shown in FIG. 6.

Figure 5:
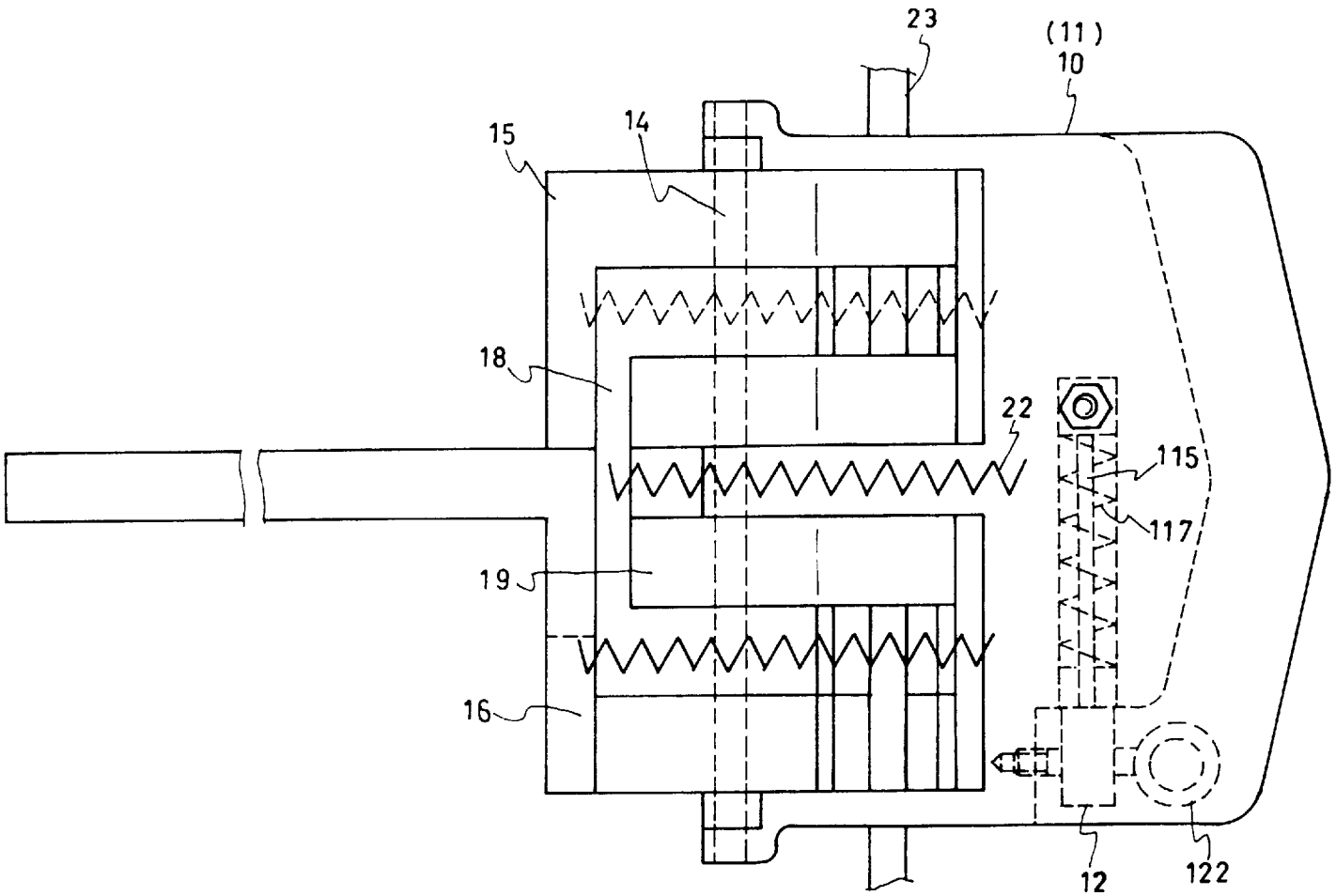
FIG. 5 is a schematic illustration of the assembly of the present invention taken from the side.

Referring to FIG. 3, the retarders 18, 19 are hingedly connected by the vertical shaft 14 (shown in FIG. 1), passing through holes 182, 192, such that the retarders 18, 19 are vertically located between the brakes 15, 16. The retarders 18, 19 have front ends with pairs of grippers 180, 190, which are in the same way located between the brakes 15, 16. Each of the grippers 180, 190 has a transverse fisheye hole 181, 191, respectively. Each of the fisheye holes 181, 191 carries a brake pad 20, having a friction pad 200 and threaded bolt 201, passing through the fisheye hole 181, 191 and fastened with a nut 203. A spring 202 on the bolt 201 presses the brake pad 20 inwards for gripping the rope, as shown in FIG. 5. The retarders 18, 19 further have rear ends with vertical holes 183, 193 for passing through a safety cord 31, which connects to a safety belt for the user, as shown in FIG. 7.

Figure 4:
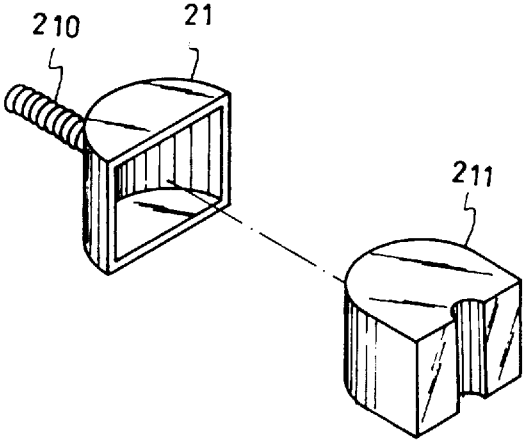
FIG. 4 is an exploded perspective view of the friction pad of the present invention.

FIG. 4 shows a brake pad in another embodiment of the present invention. Therein a friction pad 211 is inserted into a casing 21, to which a bolt 210 is attached for fastening the brake pad.

Figure 6:
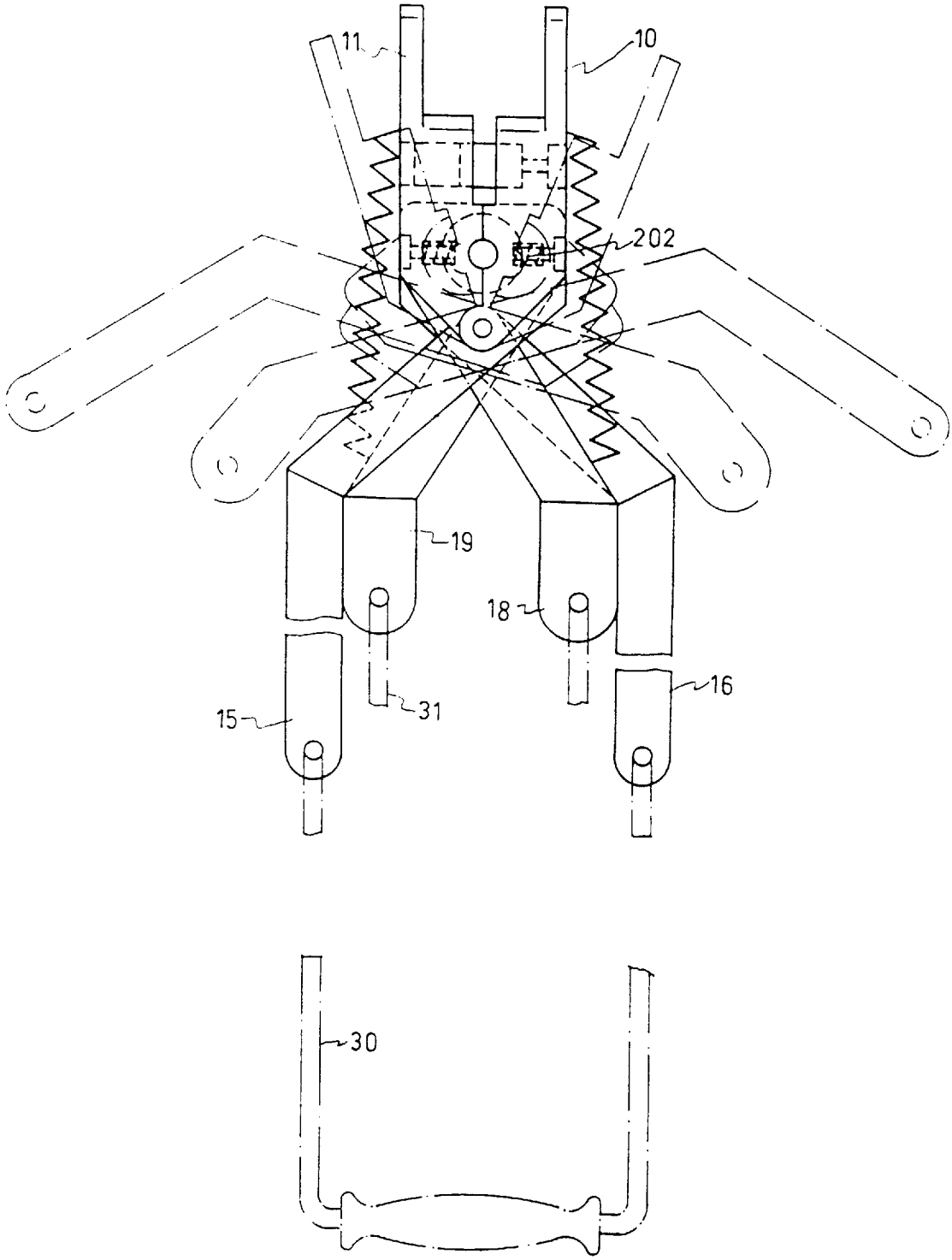
FIG. 6 is a schematic illustration of the assembly of the present invention taken from the top.
Figure 7:
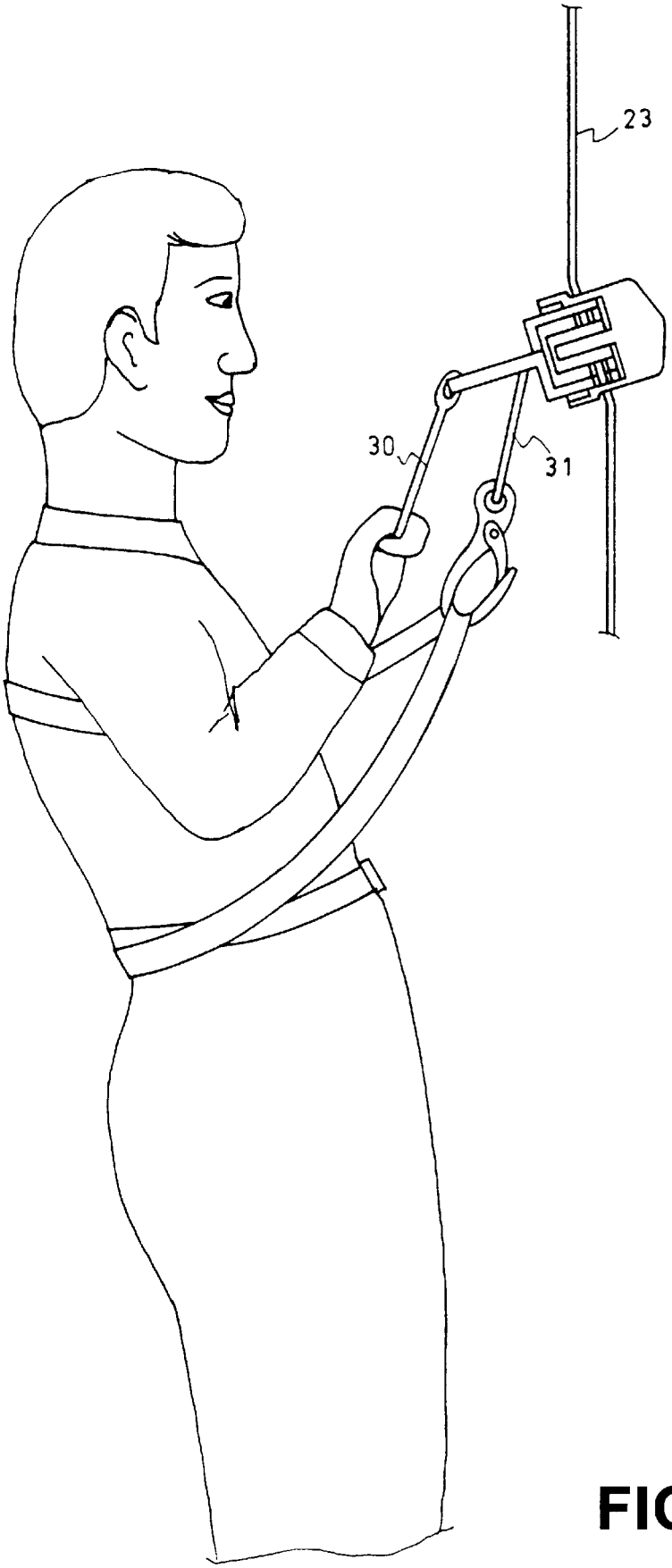
FIG. 7 is a schematic illustration of the use of the present invention.

FIGS. 5–7 show the assembly of the present invention. Therein, springs are mounted between the holders 10, 11, the brakes 15, 16 and the retarders 18, 19 for holding the brakes 15, 16 and the retarders 18, 19 open.

For use of the present invention, the blocking rod 115 is pulled down, allowing the holders 10, 11 to separate, revolving around the vertical shaft 14. The rope 23 is inserted into the guiding openings 100, 110 and the grippers 101, 111. Then the holders 10, 11 are brought together, with the blocking rod 115 and the blocking part 107 engaging, such that the holders 10, 11 will not open again. The safety cord 31, held by the retarders 18, 19, is put around the user's waist. The weight of the user, pulling on the safety cord 31, causes the retarders 18, 19 to be held together, with the effect of slowing down the descent of the user. Since the grippers 180, 190 are shaped like the letter S, uniform friction will be applied on the rope 23, avoiding uneven descent of the user. The springs 202 ensure sufficientpressure on the rope 23 for users of lightweight. By manually pulling the pulling cord 30 the user generates additional friction of the grippers 150, 160 of the brakes 15, 16 against the rope. Thus the user is able to control the velocity of descent. Due to friction by the weight of the user no large manual force is needed to apply the grippers 150, 160 on the rope 23. The user will be able to concentrate fully on regulating the velocity of descent and to react fast to any unexpected situation. Of course, the arrangement and order of grippers in the present invention may be modified according to any requirements.

Figure 8:
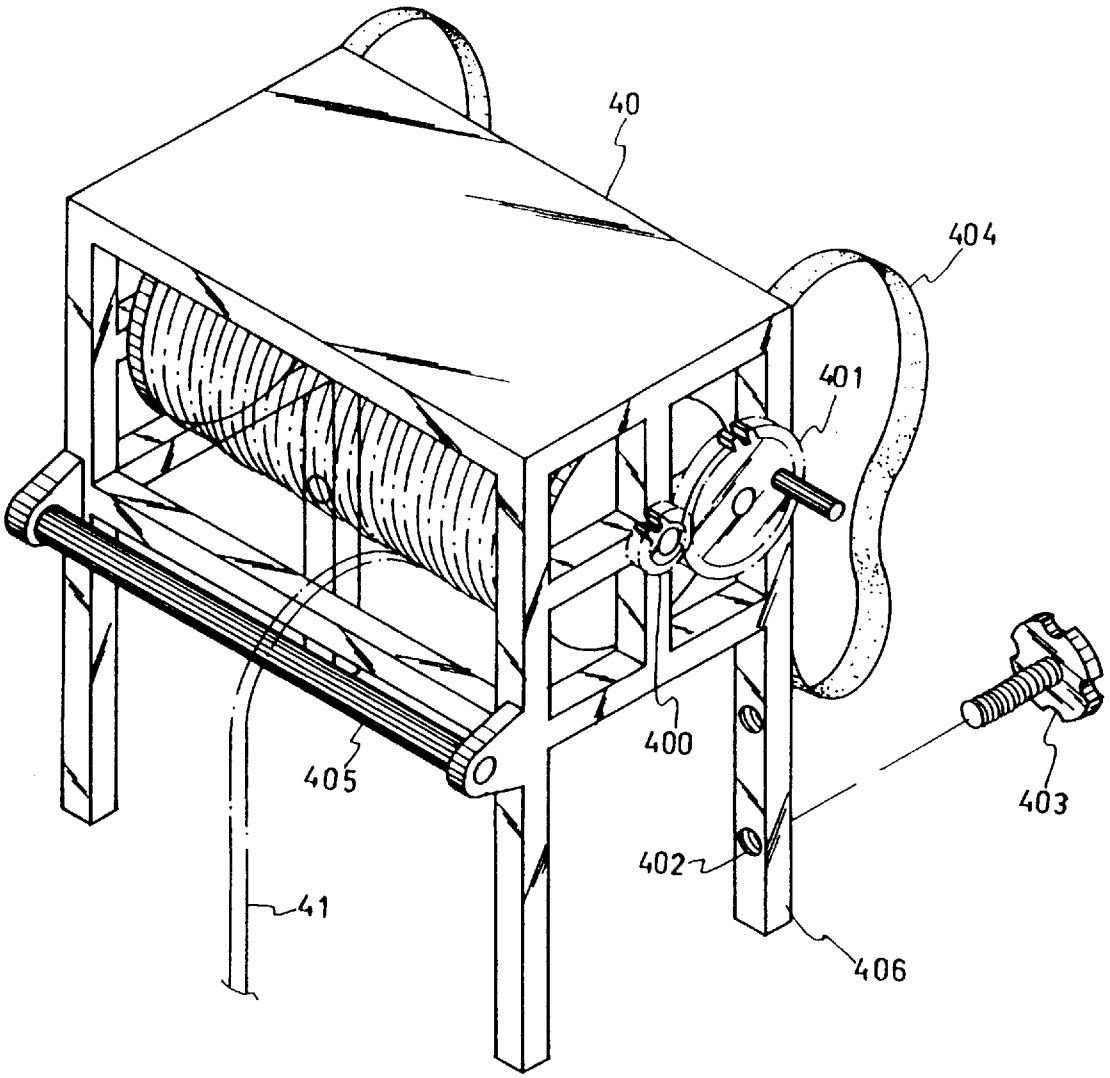
FIG. 8 is a perspective view of the frame and the rope winder of the present invention.
Figure 9:
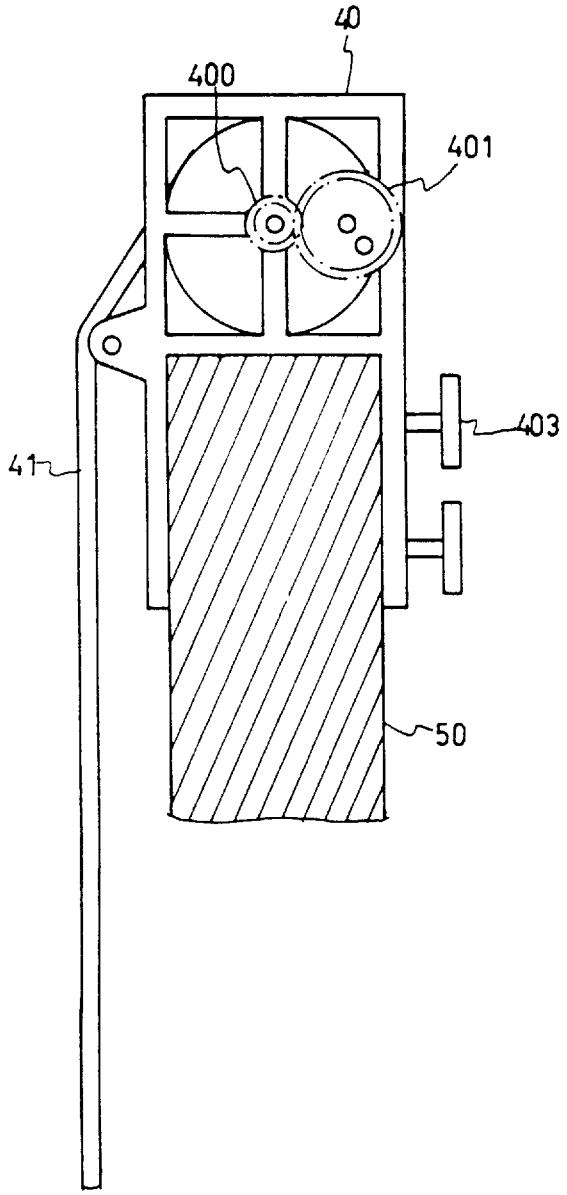
FIG. 9 is a side view of the frame and the rope winder of the present invention.

Referring to FIGS. 8 and 9, the present invention also comprises a frame 40. The frame 40 is movable to be quickly installed wherever suitable. A rope winder with a rope 41 is mounted on the frame 40. A small gear 400 is concentrically mounted on the rope winder, manually driven by a large gear 401 for winding up or releasing the rope 41. A roller 405 guides the descent of the rope 41, ensuring smooth descent thereof. Carrying belts 404 allow to carry the frame 40 readily to any desired location. The frame 40 has feet 406, which are provided with threaded holes 402 to be fastened to a wall 50 by screws 403.

As shown in FIGS. 6, 7 and 9, when the present invention is used, the frame 40 is installed at a suitable position, away from flames or other hazards, with the feet 406 fastened to the wall 50. The rope 41 is pulled out from the rope winder and laid over the roller 405. Then the blocking rod 115 inside the holder 11 is pulled down, allowing the holders 10, 11 to separate, revolving around the vertical shaft 14. The rope 41 is inserted into the guiding openings 100, 110 and the grippers 101, 111. The holders 10, 11 are brought together again, with the blocking rod 115 and the blocking part 107 engaging, such that the holders 10, 11 will not open. The retarders 18, 19 and the brakes 15, 16 are installed, with the grippers 180, 190 and 150, 160 gripping the rope 41. Due to the alternating arrangement of the grippers 180, 190 and 150, 160, uniform friction will be applied on the rope 41, which is easily controllable. The safety cord 31 is then put around the user s waist, and the user holds the pulling cord 30, climbs outside the wall 50 and starts descending by leaning on the safety cord 31 and pulling the pulling cord 30 according to the desired velocity of descent.

While the invention has been described with reference to preferred embodiments thereof, it is to be understood that modifications or variations may be easily made without departing from the spirit of this invention which is defined by the appended claims.

I claim:

1. An abseil rescue system with a velocity control system, allowing a user to descend on a rope, comprising:

two holders, hingedly connected by a vertical shaft;

two brakes, hingedly connected to each other and to said two holders by said vertical shaft; and two retarders, hingedly connected to each other and to said two holders by said vertical shaft;

wherein each of said two holders, brakes and retarders has a front end with a guiding opening to guide said rope through and with a gripper to generate friction against said rope and wherein said two brakes have rear ends connected by a pulling cord and said two retarders have rear ends connected by a safety cord for controlling said friction.

2. An abseil rescue system with a velocity control system according to claim 1, wherein springs keep said two brakes and said two retarders in a non-gripping state where no friction is applied on said rope.

3. An abseil rescue system with a velocity control system according to claim 1, wherein said grippers have brake pads connected by springs thereto.

4. An abseil rescue system with a velocity control system according to claim 3, wherein each of said brake pads has a casing and a friction pad laid therein.

5. An abseil rescue system with a velocity control system according to claim 1, further comprising a frame, having a rope winder, which is manually driven by a large gear and a small gear,and feet to be fastened to a wall.

6. An abseil rescue system with a velocity control system according to claim 5, wherein said feet are fastened to said wall by screws.

7. An abseil rescue system with a velocity control system according to claim 5, wherein said frame further has a roller, allowing for smooth descent of said rope from said rope winder.

* * * * *